US008066357B2

(12) United States Patent
Nakashima

(10) Patent No.: US 8,066,357 B2
(45) Date of Patent: Nov. 29, 2011

(54) INK-JET PRINTER

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1068 days.

(21) Appl. No.: 11/677,311

(22) Filed: Feb. 21, 2007

(65) Prior Publication Data

US 2007/0200905 A1 Aug. 30, 2007

(30) Foreign Application Priority Data

Feb. 24, 2006 (JP) ..... 2006-048884

(51) Int. Cl.
*B41J 2/175* (2006.01)

(52) U.S. Cl. ..... 347/85; 347/40; 346/134

(58) Field of Classification Search ..... 347/84–89
See application file for complete search history.

(56) References Cited

U.S. PATENT DOCUMENTS 4,223,323 A * 9/1980 Bader et al. ..... 347/85
4,342,042 A * 7/1982 Cruz-Uribe et al. ..... 347/7
4,383,263 A * 5/1983 Ozawa et al. ..... 347/30
4,394,669 A * 7/1983 Ozawa et al. ..... 347/86
4,403,233 A * 9/1983 Terasawa et al. ..... 347/30
4,429,320 A * 1/1984 Hattori et al. ..... 347/86
4,527,175 A * 7/1985 Kojima et al. ..... 347/85
4,558,326 A * 12/1985 Kimura et al. ..... 347/30
4,620,198 A * 10/1986 Behun ..... 347/43
4,680,696 A * 7/1987 Ebinuma et al. ..... 347/85
4,831,389 A * 5/1989 Chan ..... 347/86
4,893,137 A * 1/1990 Ebinuma et al. ..... 346/134
4,968,998 A * 11/1990 Allen ..... 347/7
4,999,652 A * 3/1991 Chan ..... 347/86
5,369,429 A * 11/1994 Erickson ..... 347/7
5,675,367 A * 10/1997 Scheffelin et al. ..... 347/86
5,691,754 A * 11/1997 Ta ..... 347/85
5,732,751 A * 3/1998 Schmidt et al. ..... 141/48

(Continued)

FOREIGN PATENT DOCUMENTS

EP 0271090 A2 6/1988

(Continued)

OTHER PUBLICATIONS

European Patent Office, European Search Report for EP Appl'n. No. 07250741.

(Continued)

*Primary Examiner* — Charlie Peng
*Assistant Examiner* — Peter Radkowski
(74) *Attorney, Agent, or Firm* — Baker Botts L.L.P.

(57) ABSTRACT

An object of the present invention is to reduce force acting, when an ink-jet head moves, on a distal end portion of an ink supply pipe connected to a brancher, to thereby prevent damage to the ink supply pipe as much as possible. An ink supplier, which supplies ink to respective ink introduction ports of at least one ink-jet head, has an ink supply pipe connected to an ink cartridge, a brancher to which a distal end portion of the ink supply pipe connected, and branch pipes extending from the brancher to the respective ink introduction ports. The brancher and the branch pipes are adapted to move integrally with the at least on ink-jet head, and in addition the distal end portion of the ink supply pipe and the brancher are connected to each other in a relatively rotatable manner.

13 Claims, 7 Drawing Sheets

U.S. PATENT DOCUMENTS

| | | | | | |
|---|---|---|---|---|---|
| 5,748,216 | A | * | 5/1998 | Scheffelin et al. | 347/87 |
| 5,777,648 | A | * | 7/1998 | Scheffelin et al. | 347/87 |
| 5,801,735 | A | * | 9/1998 | Lorenze et al. | 347/85 |
| 5,821,966 | A | * | 10/1998 | Schell et al. | 347/86 |
| 5,877,793 | A | * | 3/1999 | Erickson | 347/85 |
| 5,912,688 | A | * | 6/1999 | Gragg | 347/86 |
| 5,963,238 | A | * | 10/1999 | Scheffelin et al. | 347/85 |
| 5,975,677 | A | * | 11/1999 | Marler et al. | 347/40 |
| 6,158,849 | A | * | 12/2000 | Veciana et al. | 347/85 |
| 6,164,766 | A | * | 12/2000 | Erickson | 347/85 |
| 6,183,078 | B1 | * | 2/2001 | Pietrzyk et al. | 347/92 |
| 2005/0220524 | A1 | | 10/2005 | Ouchi | |

FOREIGN PATENT DOCUMENTS

| | | | | |
|---|---|---|---|---|
| GB | 2089733 | A | | 6/1982 |
| GB | 2089733 | A | | 7/2007 |
| JP | S63-145071 | A | | 6/1988 |
| JP | S63-254048 | A | | 10/1988 |
| JP | 6171104 | A | | 6/1994 |
| JP | 200196762 | A | | 4/2001 |
| JP | 2003-112429 | A | | 4/2003 |
| JP | 2004122633 | A | | 4/2004 |
| JP | 2005-169928 | A | | 6/2005 |
| JP | 2005169928 | A | * | 6/2005 |
| JP | 2005288753 | A | | 10/2005 |

OTHER PUBLICATIONS

Japan Patent Office; Notice of Reasons for Rejection in Japanese Patent Application No. 2006-048884 mailed Jan. 12, 2010.

* cited by examiner

INK-JET PRINTER

BACKGROUND OF THE INVENTION

1. Field of the Invention

The present invention relates to an ink-jet printer that performs recording by ejecting ink to a recording medium.

2. Description of the Related Art

Conventionally, there is widely known a serial-type ink-jet printer including an ink-jet head that ejects ink to a recording medium such as a recording paper while moving in a direction perpendicular to a direction in which the recording medium is conveyed. Among such ink-jet printers, in particular, an ink-jet printer disclosed in Japanese Patent Unexamined Publication No. 2005-288753 (FIG. 3) for example includes ink cartridges (ink supply sources) that are fixedly provided and an ink-jet head that can move reciprocatingly in a widthwise direction of a recording paper conveyed. The ink cartridges and the ink-jet head are connected via a flexible tube. Ink supplied from the ink cartridge through the tube is ejected to a recording paper from a nozzle of the ink-jet head that is moving reciprocatingly.

In a case where several ink-jet head eject the same type (color) of ink, a brancher that branches an ink supply path, which is formed of a single tube, into several paths is required in order that ink is supplied from one ink cartridge to several ink-jet heads, respectively. However, when the brancher is provided in an ink-jet head side and moves integrally with the ink-jet head, a distal end portion of the tube connected to the brancher repeatedly receives stress while the ink-jet head is moving.

On the other hand, a diameter of the tube is preferably as large as possible, for the purpose of smooth ink supply from the ink cartridge to the ink-jet head. In general, a tube is often made of a synthetic resin material or the like, which may sometimes cause air to penetrate through the tube and mix into ink in the tube. Therefore, in order to prevent air from penetrating through the tube as much as possible, a wall thickness of the tube is preferably as large as possible. However, when the diameter and the wall thickness of the tube are made large like this, rigidity of the tube is accordingly increased. This makes it difficult that the tube absorbs, by its bending deformation, force acting thereon during movement of the ink-jet head. As a result, the distal end portion of the tube receives larger stress, and therefore a cracking due to fatigue failure or the like is more likely to occur in the tube.

SUMMARY OF THE INVENTION

An object of the present invention is to reduce force acting, when an ink-jet head moves, on a distal end portion of an ink supply pipe connected to a brancher, to thereby prevent damage to the ink supply pipe as much as possible.

According to an embodiment of the present invention, there is provided an ink-jet printer including at least one ink-jet head that ejects ink while moving in one predetermined direction and an ink supplier that supplies ink to a plurality of ink introduction ports of the at least one ink-jet head. The ink supplier includes an ink supply pipe, a brancher, and a plurality of branch pipes. The ink supply pipe is connected to an ink supply source. The brancher, to which a distal end portion of the ink supply pipe is connected, branches an ink supply path formed of the ink supply pipe into a plurality of paths. The plurality of branch pipes extend from the brancher respectively to the plurality of ink introduction ports of the at least one ink-jet head. The brancher and the plurality of branch pipes are adapted to move in the one predetermined direction integrally with the at least one ink-jet head. The distal end portion of the ink supply pipe and the brancher are connected to each other in a relatively rotatable manner.

In the above ink-jet printer, ink in the ink supply source is supplied through the ink supply pipe and the brancher to each of the ink introduction ports of the at least one ink-jet head. Here, the distal end portion of the ink supply pipe that extends from the ink supply source, and the brancher that moves integrally with the at least one ink-jet head are connected to each other in a relatively rotatable manner. Therefore, while the ink-jet head is moving, force acting on the distal end portion of the ink supply pipe connected to the brancher is reduced, so that damage to the ink supply pipe is prevented as much as possible.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
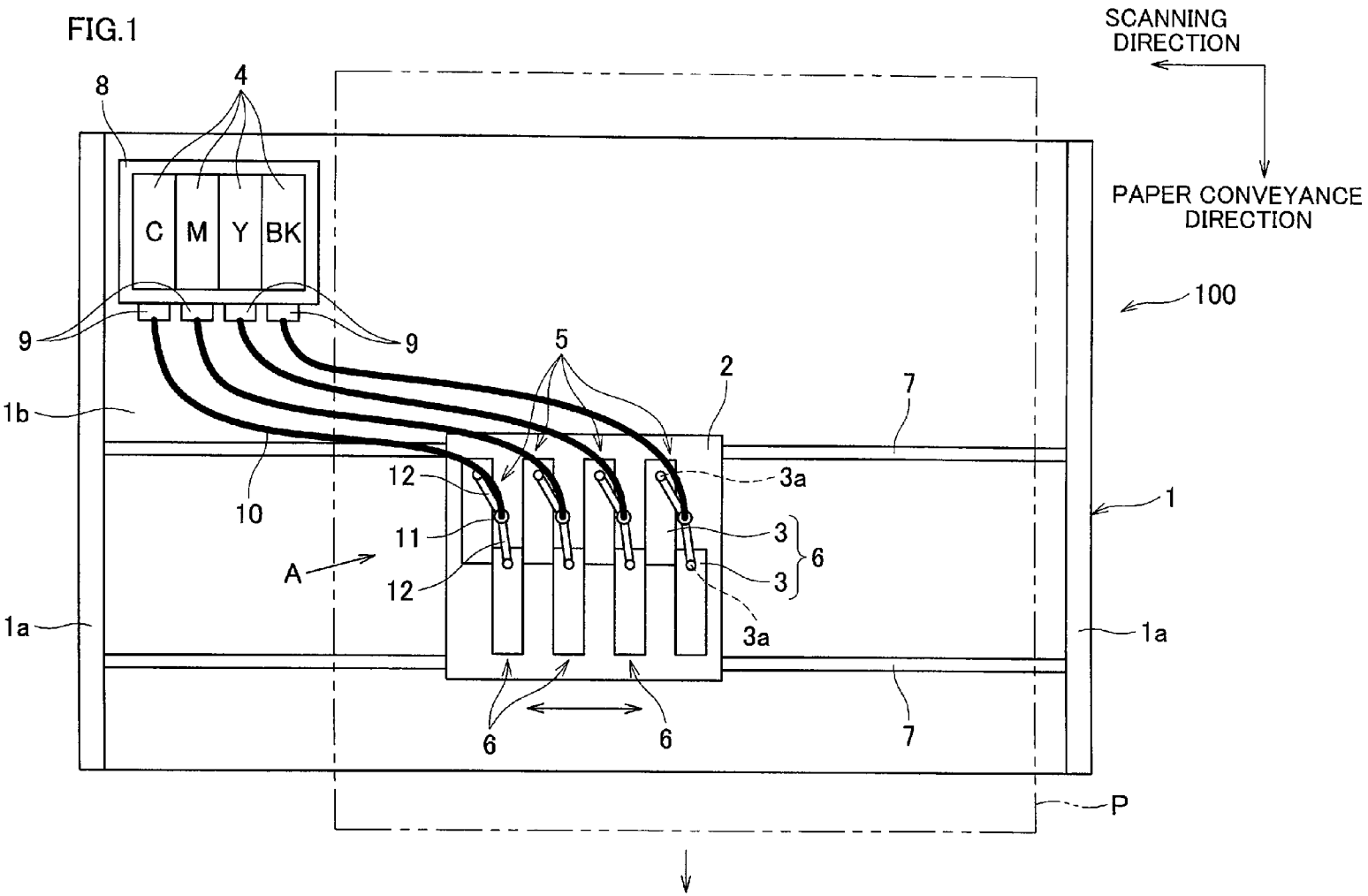
FIG. 1 is a schematic plan view of an ink-jet printer according to an embodiment of the present invention.

Next, an embodiment of the present invention will be described. As shown in FIG. 1, an ink-jet printer 100 of this embodiment includes a carriage 2, ink-jet heads 3, ink cartridges 4 (ink supply source), and ink suppliers 5. The carriage 2 is provided on a main body frame 1 so as to be movable in a horizontal direction in FIG. 1 (i.e., in a scanning direction). The ink-jet heads 3 are mounted on the carriage 2, and eject ink to a recording paper P while moving in the horizontal direction together with the carriage 2. The ink cartridges 4 contain ink therein. The ink suppliers 5 supply ink contained in the ink cartridges 4 to the ink-jet heads 3. The recording paper P is conveyed in a paper conveyance direction indicated by an arrow depicted in FIG. 1 by means of an unillustrated conveyance mechanism.

The carriage 2 is provided along two guide shafts 7, so as to be movable reciprocatingly in the scanning direction. The two guide shafts 7 are disposed in parallel so as to span two side walls 1*a* of the main body frame 1. On the carriage 2, eight ink-jet heads 3 are arranged in the scanning direction. Each of the eight ink-jet heads 3 ejects any one of four kinds of ink (that is, cyan ink (C), magenta ink (M), yellow ink (Y), and black ink (BK)) contained in the four ink cartridges 4. By these four kinds of ink, the eight ink-jet heads 3 can record a color image on the recording paper P.

Each ink-jet head 3 has, on its upper face, an ink introduction port 3*a*. By the ink supplier 5, ink contained in the ink cartridge 4 is supplied to the ink introduction port 3*a*. On a lower face of each ink-jet head 3 which is opposed to the recording paper P, unillustrated nozzles are arranged in the paper conveyance direction (i.e., in an up-and-down direction in FIG. 1). Ink introduced from the ink introduction port 3*a* is supplied to the respective nozzles. Every two ink-jet heads 3 neighboring with respect to the scanning direction are disposed out of alignment so that nozzle rows of the respective ink-jet heads 3 do not overlap each other when seen in the scanning direction. These two ink-jet heads 3 constitute one head set 6. That is, four head sets 6 each made up of two ink-jet heads 3 are arranged in the scanning direction. In addition, two ink-jet heads 3 constituting one head set 6 eject the same kind (the same color) of ink from their nozzles. The four head sets 6 eject the four different kinds of ink from their nozzles, respectively.

A holder 8 is fixedly provided on a bottom 1*b* of the main body frame 1. Four ink cartridges 4, which contain four kinds of ink, respectively, are removably mounted on the holder 8. Provided at an outside of the holder 8 are four pumps 9 each connected to each of the four ink cartridges 4. Ink led out of each of the four ink cartridges 4 is pressurized by each of the four pumps 9, and supplied through a later-described ink supplier 5 to two ink-jet heads 3 that constitute one head set 6.

Figure 2:
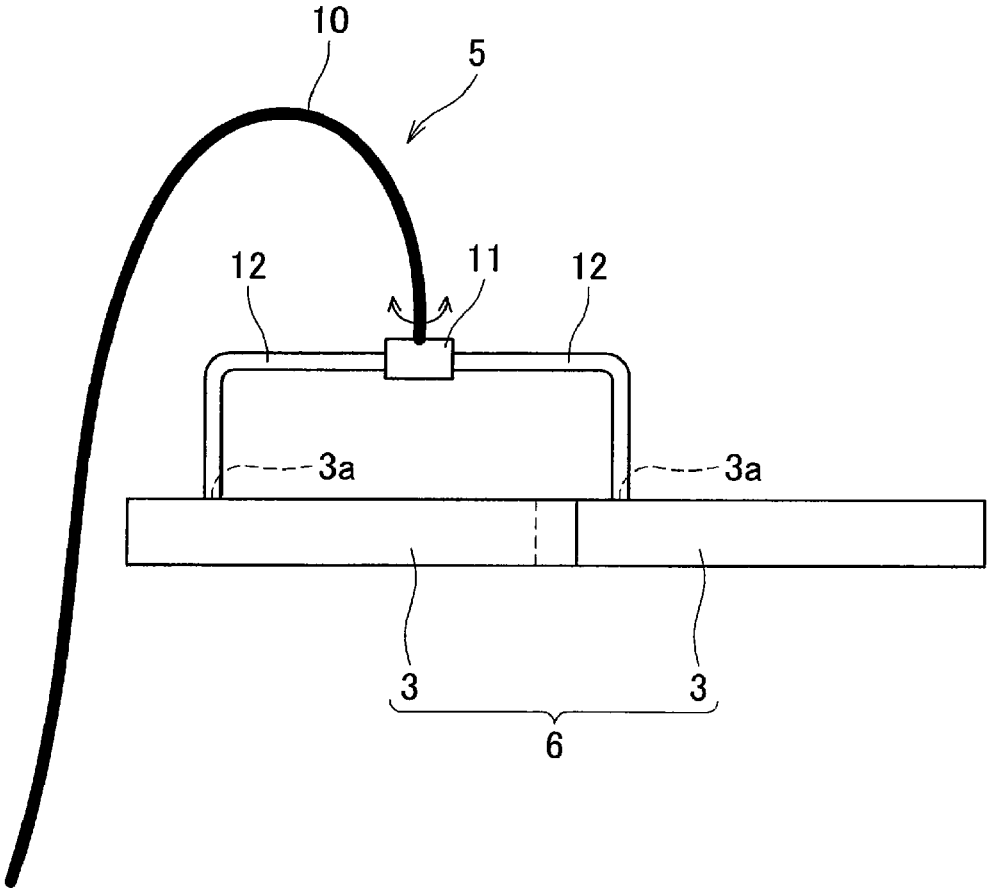
FIG. 2 shows an ink-jet head and an ink supplier as seen in an arrow A direction in FIG. 1.

As shown in FIG. 1, four ink suppliers 5 are provided corresponding to the four head sets 6. Each of the ink suppliers 5 is adapted to supply one kind of ink contained in one ink cartridge 4 to two ink-jet heads 3 included in one head set 6. As shown in FIGS. 1 and 2, each of the ink suppliers 5 includes an ink supply pipe 10, a brancher 11, and two branch pipes 12. The ink supply pipe 10 is connected via the pump 9 to the ink cartridge 4. The brancher 11 branches one ink supply path, which is formed of the ink supply pipe 10, into two. The two branch pipes 12 extend from the brancher 11 respectively to two ink introduction ports 3*a* of two ink-jet heads 3 forming one head set 6.

Figure 3:
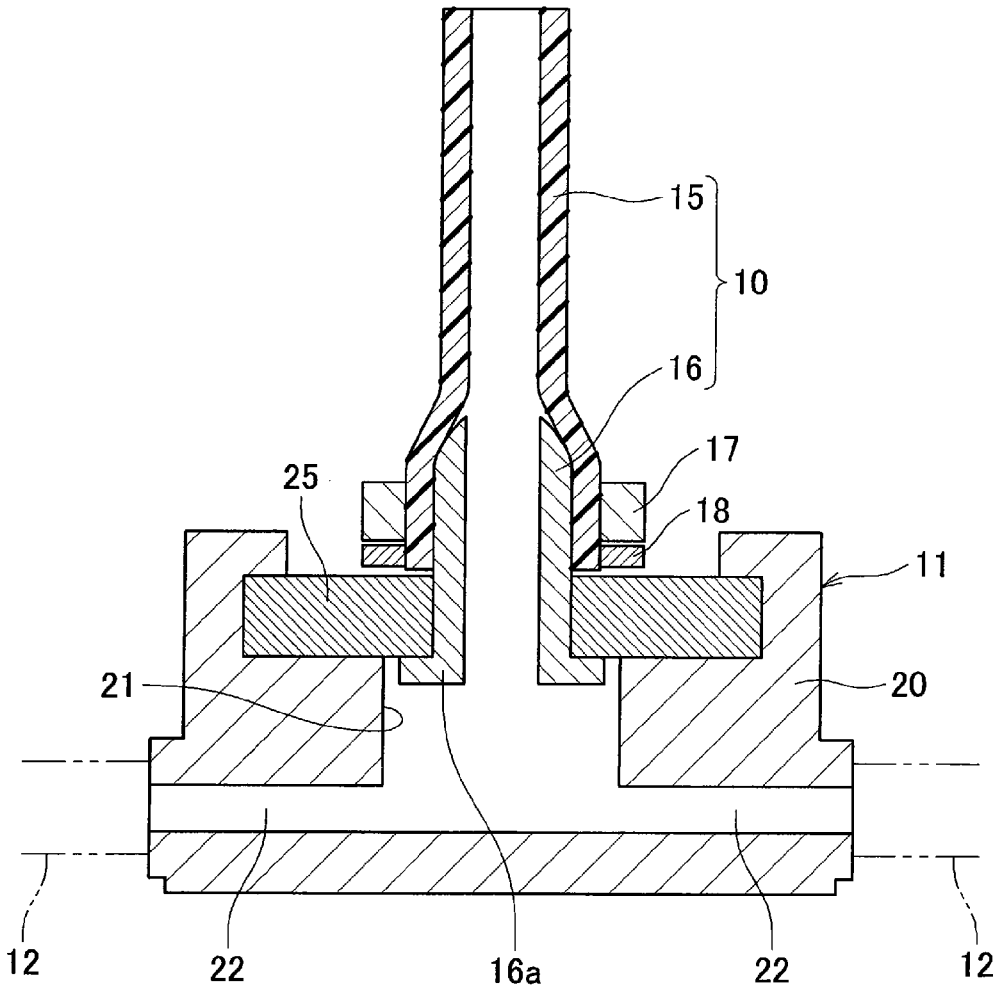
FIG. 3 shows a vertical section of a distal end portion of an ink supply pipe and a brancher.

As shown in FIG. 3, the ink supply pipe 10 has a tube 15 and a connecting pipe 16. The tube 15 is made of a flexible material such as a synthetic resin material or the like. The connecting pipe 16 is partially inserted into a distal end portion of the tube 15. A clip 17 and a ring-shaped fixture 18 are attached to the distal end portion of the tube 15. The clip 17 pinches a portion into which the connecting pipe 16 is inserted, from radially outside thereof. The fixture 18 clamps the portion into which the connecting pipe 16 is inserted, over an entire circumference thereof. By the clip 17 and the fixture 18, the connecting pipe 16 is fixed to the distal end portion of the tube 15. As shown in FIG. 1, a base end portion of the tube 15 is connected to an outlet of the pump 9, while the distal end portion of the tube 15 is connected via the connecting pipe 16 to the brancher 11.

As shown in FIG. 3, the brancher 11 has a brancher main body 20 in which an ink passage is formed. The ink passage formed in the brancher main body 20 is made up of an insertion hole 21 and two branch passages 22. The connecting pipe 16 fixed to the distal end portion of the tube 15 is inserted into the insertion hole 21. The two branch passages 22 branch from the insertion hole 21, and communicate with two branch pipes 12, respectively. The insertion hole 21 extends downward from an upper end of the brancher main body 20. From a lower end of the insertion hole 21, the two branch passages 22 extend horizontally to both side faces of the brancher main body 20. Ink flowing through the ink supply pipe 10 into the brancher 11 is divided from insertion hole 21 into two branch passages 22, and flows to the two branch pipes 12. As shown in FIGS. 1 and 2, the brancher 11, which is connected via two branch pipes 12 to two ink-jet heads 3, is disposed at such a position that, in top and side views, two ink introduction ports 3*a* of the respective two ink-jet heads 3 are equidistant from the brancher 11.

As shown in FIG. 2, each of the two branch pipes 12 has an L-shaped form which is bent midway thereof at a right angle. The branch pipe 12 is a metal-made pipe having a relatively high rigidity. Accordingly, air is prevented from penetrating through the branch passage 12 and thus mixing into ink in the branch passage 12.

Figure 4:
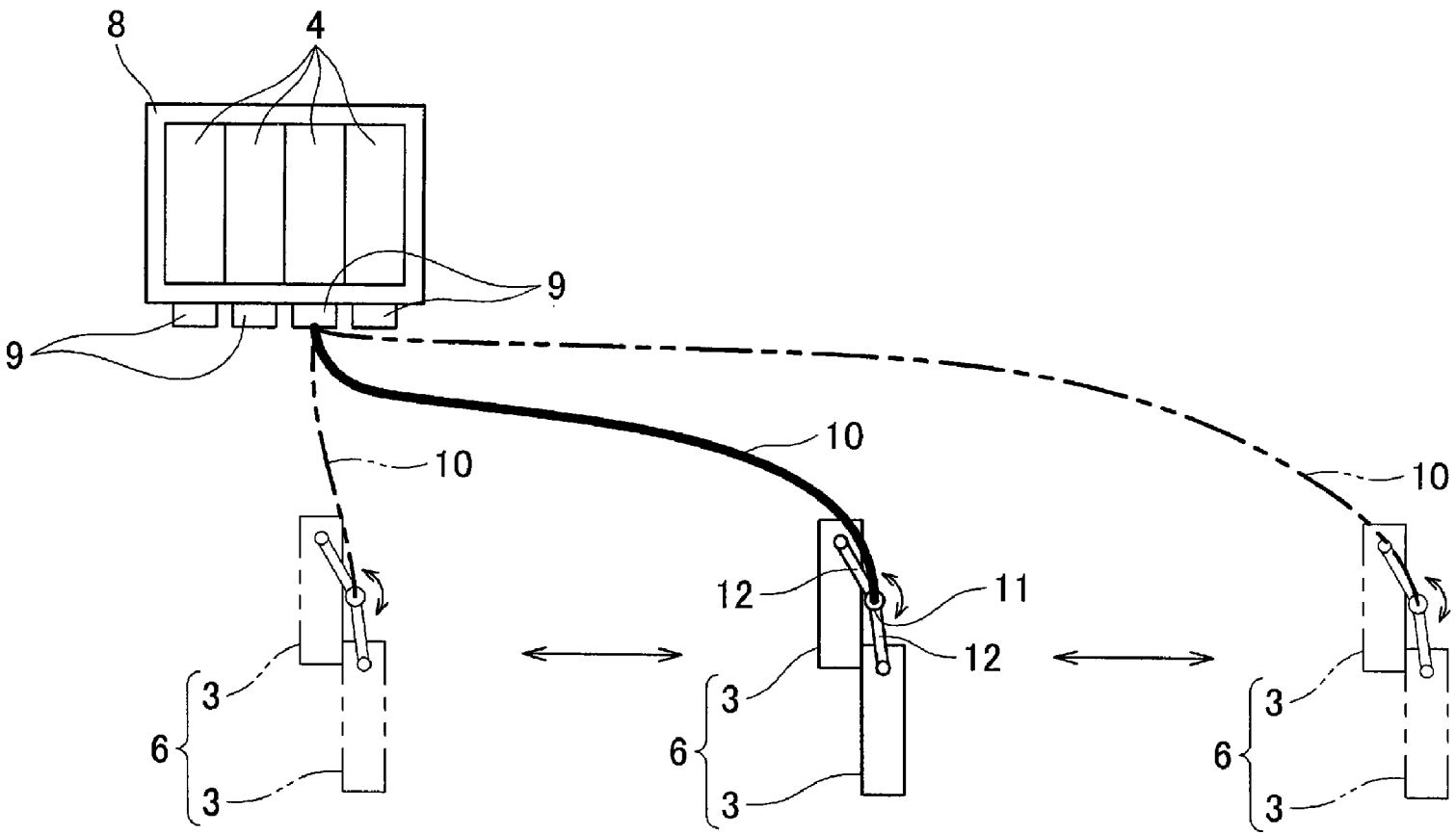
FIG. 4 shows that the brancher and branch pipes are moving integrally with the ink-jet head.

Both ends of each branch pipe 12 are connected to a side face of the brancher main body 20 and to an upper face of the ink-jet head 3, and communicate with an open end of the branch passage 22 and with the ink introduction port 3*a* of the ink-jet head 3, respectively. Ink contained in the two branch passages 22 of the brancher main body 20 is supplied through the two branch pipes 12 to the two ink-jet heads 3 that eject the same color of ink. The brancher 11 is fixed to the two ink-jet heads 3 via the two branch pipes 12. Accordingly, as shown in FIG. 4, when the carriage 2 and ink-jet heads 3 moves in the scanning direction, the brancher 11 and the two branch pipes 12 also move in the scanning direction integrally with the ink-jet heads 3.

Here, as shown in FIG. 3, an annular sealing member 25 as a sealer is provided at a portion of the brancher main body 20 on an upper side of the insertion hole 21. The connecting pipe 16 is inserted through the annular sealing member 25 in a slidably rotatable manner. The sealing member 25 thus interposed between the insertion hole 21 and the connecting pipe 16 can prevent ink from leaking to outside through between the connecting pipe 16 and the brancher main body 20, and besides can prevent foreign materials such as air, paper powder, dust and the like existing outside from mixing into ink.

Moreover, the connecting pipe 16 is slidably rotatable with respect to the sealing member 25, and thus the connecting pipe 16 is permitted to rotate with respect to the brancher main body 20. Therefore, ink supply pipe 10 including the connecting pipe 16 and brancher 11 including the brancher main body 20 are connected to each other in a relatively rotatable manner. That is, as shown in FIG. 4, while the ink-jet heads 3 are moving, a distal end portion of the ink supply pipe 10 that is connected to the fixed ink cartridge 4 can rotate with respect to the brancher 11 which is moving integrally with the ink-jet heads 3. This reduces force acting on the distal end portion of the tube 15 of the ink supply pipe 10, and therefore damage to the tube 15 can be prevented as much as possible.

As the sealing member 25, though various structure can be employed, one having a structure equivalent to a common sealing member such as an oil seal, which is in wide use in preventing liquid leakage at a bearing of a rotation shaft for example, can be adopted. To be more specific, it may be possible that the sealing member 25 includes an annular lip made of a rubber material and a spring that presses the lip to an outer surface of the connecting pipe 16 so that the lip pressed by the spring is, in a relatively slidable manner, in close contact with the outer surface of the connecting pipe 16 over an entire circumference thereof.

As shown in FIG. 3, a flange 16*a* protruding radially outward is formed at an end portion of the connecting pipe 16 over an entire circumference thereof. The flange 16*a* is engaged with a lower face of the sealing member 25. Therefore, even when upper pulling force acts on the connecting pipe 16 during movement of the ink-jet heads 3, the connecting pipe 16 can surely be prevented from falling out of the brancher 11 supporting the sealing member 25 because the flange 16*a* functions as an anti-falling stopper.

As described above, the brancher 11 is disposed at such a position that two ink introduction ports 3*a*, to which the brancher 11 is connected via two branch pipes 12, are equidistant from the brancher 11. Accordingly, during reciprocating movement of the ink-jet heads 3, force acting on the brancher main body 20 via the ink supply pipe 10 is dispersed equally to the branch pipes 12. This can prevent external force from concentrating on one of the branch pipes 12. In addition, since the brancher 11 can divide ink equally between the two ink-jet heads 3, a flow condition such as pressure, a flow rate and the like of ink, which has been supplied from one ink supply pipe 10 into two ink introduction ports 3*a*, can be made uniform as much as possible.

Moreover, since the branch pipe 12 is a metal-made pipe having high rigidity, deflection of the branch pipe 12, which is caused when the ink-jet heads 3 move reciprocatingly, is reduced. Accordingly, a position of the brancher 11 becomes less unsettled, to enable the connecting pipe 16 to more stably rotate with respect to the brancher main body 20, so that force acting on the distal end portion of the tube 15 is further reduced.

Next, various modifications of the above-described embodiment will be described. Here, the same constructions as in the above-described embodiment will be denoted by the common reference characters, and descriptions thereof will be appropriately omitted.

Figure 5:
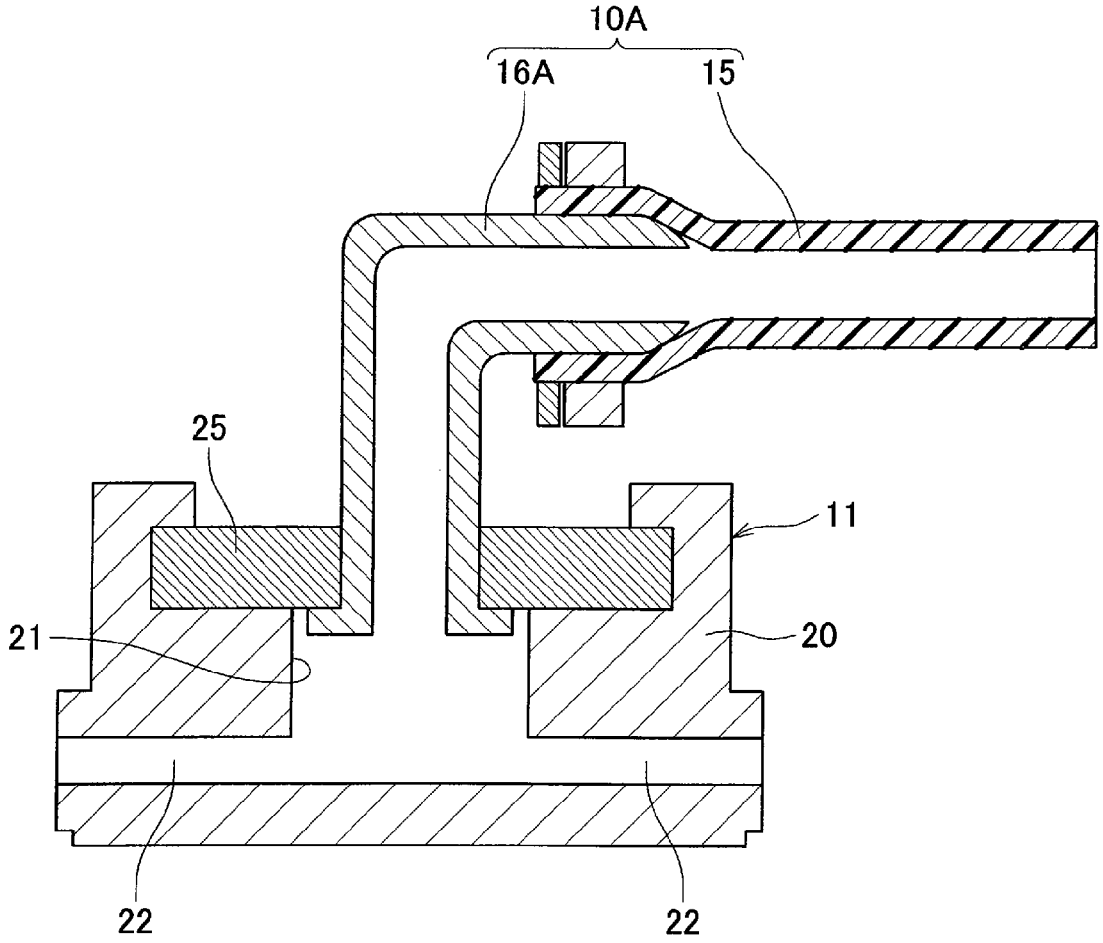
FIG. 5 shows a vertical section of a distal end portion of an ink supply pipe and a brancher according to a first modification.
Figure 6:
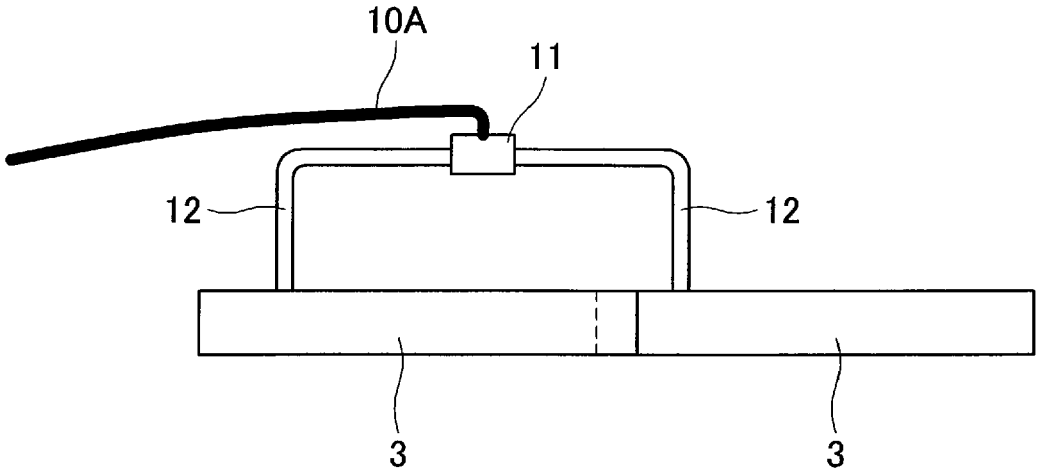
FIG. 6 shows an ink-jet head and an ink supplier according to the first modification.

[1] As shown in FIG. 5, a connecting pipe 16A may have an L-shaped form which is bent midway thereof at a right angle (first modification). In this case, as shown in FIG. 6, a tube 15 of an ink supply tube 10A can be disposed along a horizontal plane or a plane of movement of the ink-jet heads 3. As a consequence, force acting on the tube 15 during reciprocating movement of the ink-jet heads 3 can be further reduced.

[2] In the above-described embodiment, the ink supplier 5 is adapted to supply the same color of ink from one cartridge 4 to two ink introduction ports 3*a* of two ink-jet heads 3. Instead, however, it may also be possible that one ink-jet head has several ink introduction ports so that an ink supplier supplies ink to the several ink introduction ports, respectively.

Figure 7:
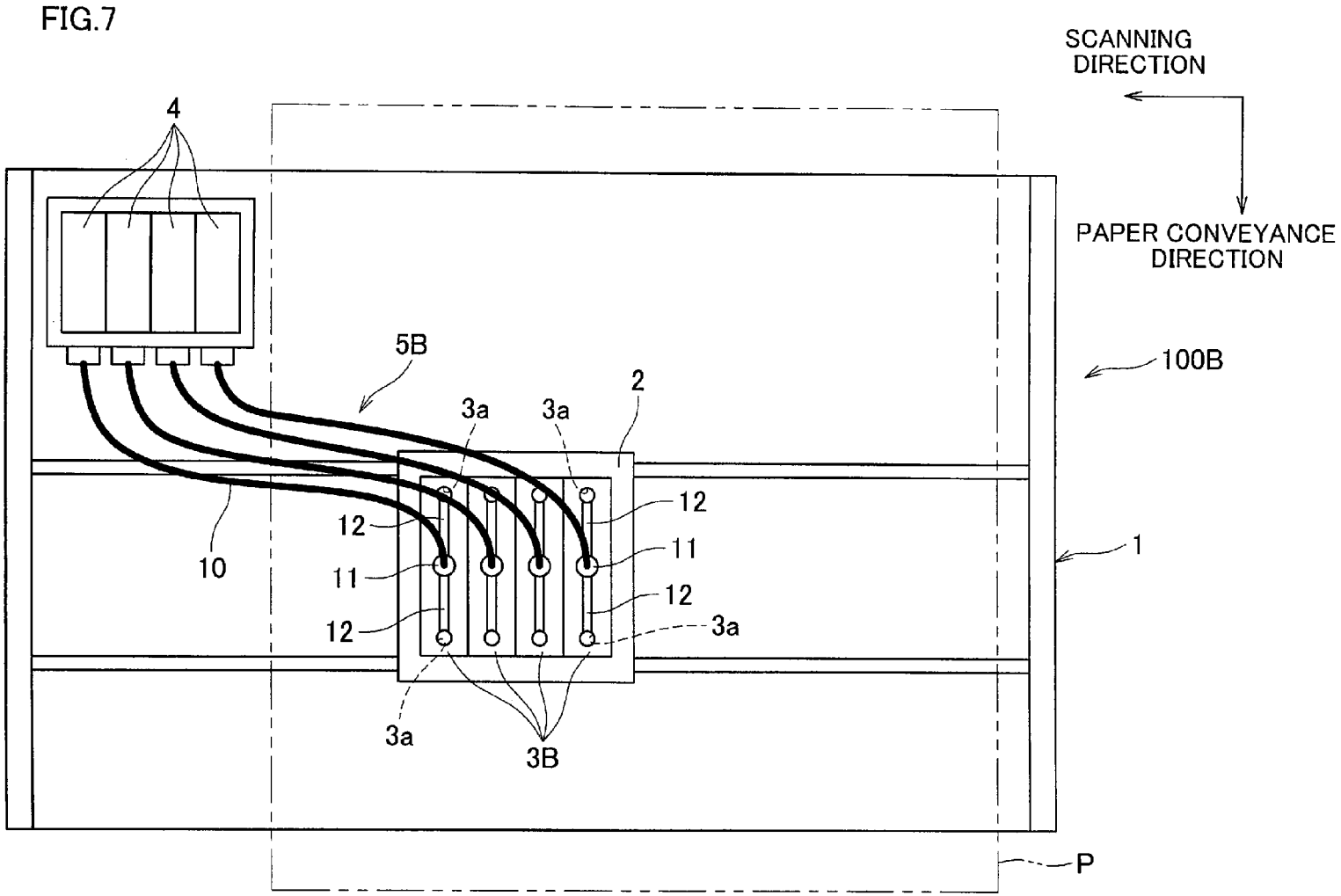
FIG. 7 is a schematic plan view of an ink-jet printer according to a second modification.

For example, in an ink-jet printer 100B shown in FIG. 7, one ink-jet head 3B has two ink introduction ports 3*a*, and an ink supplier 5B is adapted to supply ink respectively to two ink introduction ports 3*a* of one ink-jet head 3B (second modification). That is, a distal end portion of an ink supply pipe 10 is connected to a brancher 11 in a relatively rotatable manner, and besides the brancher 11 is connected via two branch pipes 12 to two ink introduction ports 3*a* of one ink-jet head 3B. In this construction as well, during movement of the ink-jet head 3B, force acting on the distal end portion of the ink supply pipe 10 connected to the brancher 11 is reduced, so that damage to the ink supply pipe 10 including the tube 15 is prevented as much as possible.

[3] In the above-described embodiment, the brancher 11 is fixed to the ink-jet heads 3 via the two branch pipes 12 (see FIG. 2). Instead, however, it may also be possible that a brancher 11 is fixed to a carriage 2 so as to move integrally with the ink-jet heads 3.

[4] At a brancher, an ink supply path may not necessarily branch into two, but may branch into three or more paths.

[5] In the above-described embodiment, the connecting pipe 16 fixed to the distal end portion of the tube 15 is connected to the brancher 11 in a relatively rotatable manner. Instead, however, it may also be possible to omit the connecting pipe 16 so that a distal end portion of a tube 15 is directly connected to the brancher 11. Alternatively, it may also be possible that an ink supply pipe does not have a flexible portion such as the tube 15 but a whole of the ink supply pipe is a rigid pipe.

[6] In the above-described embodiment, the holder 8 that receives the ink cartridges 4 is provided at an end portion of the bottom 1*b* of the main body frame 1 with respect to the scanning direction (see FIG. 1). However, the holder 8 may alternatively be provided at a central portion of the bottom 1*b* with respect to the scanning direction. Such a construction allows the ink supply pipe 10 to be more shortened.

[7] In the above-described embodiment, the holder 8 that receives the ink cartridges 4 is provided fixedly to the bottom 1*b* of the main body frame 1. However, it may also be possible that the holder 8 is provided rotatably around a shaft that is perpendicular to a plane of the bottom 1*b* (which means a shaft perpendicularly crossing the drawing sheet of FIG. 1). Such a construction allows the holder 8 to rotate while the carriage 2 is moving in the scanning direction. Therefore, load acting on an end portion of the ink supply pipe 10 connected to the pump 9 is reduced to thereby further prevent damage to the ink supply pipe 10.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet printer comprising:

at least one ink-jet head that includes a plurality of ink introduction ports;

a carriage that carries thereon the at least one ink-jet head and reciprocates in a reciprocating direction when the at least one ink-jet head ejects ink; and an ink supplier that is disposed outside the at least one ink-jet head and supplies ink to the ink introduction ports of the at least one ink-jet head, wherein:

the ink supplier comprises:

an ink supply pipe that is connected to an ink supply source, a brancher to which a distal end portion of the ink supply pipe is connected and that branches an ink supply path formed by the ink supply pipe into a plurality of paths, and a plurality of branch pipes that extend from the brancher respectively to the ink introduction ports of the at least one ink-jet head;

the brancher and the branch pipes are configured to move in a direction parallel to the reciprocating direction of the carriage integrally with the at least one ink-jet head when the carriage reciprocates in the reciprocating direction;

the distal end portion of the ink supply pipe is connected to the brancher in a direction perpendicular to the reciprocating direction of the carriage, and is configured to rotate relative to the brancher about an axis perpendicular to the reciprocating direction of the carriage when the carriage reciprocates in the reciprocating direction;

the branch pipes comprises a first branch pipe and a second branch pipe that are in fluid communication with each other via the brancher; and the ink introduction ports of the at least one ink-jet head comprises a first ink introduction port connected to the first branch pipe and a second ink introduction port connected to the second branch pipe.

2. The ink-jet printer according to claim 1, wherein the brancher is disposed at such a position that the plurality of ink introduction ports of the at least one ink-jet head are equidistant from the brancher.

3. The ink-jet printer according to claim 1, wherein the brancher is made of a metal.

4. The ink-jet printer according to claim 1, wherein the distal end portion of the ink supply pipe has an L-shaped form bent at a right angle.

5. The ink-jet printer according to claim 1, wherein the brancher comprises:

a brancher main body that includes an insertion hole into which the distal end portion of the ink supply pipe is inserted, and a plurality of branch passages each branching from the insertion hole and communicating with each of the plurality of branch pipes; and an annular sealer that is interposed between the distal end portion of the ink supply pipe and the insertion hole of the brancher main body, to seal between the ink supply pipe and the insertion hole while permitting the distal end portion of the ink supply pipe to rotate relative to the brancher main body about the axis perpendicular to the reciprocating direction of the carriage.

6. The ink-jet printer according to claim 5, wherein an anti-falling stopper that prevents the ink supply pipe from falling out of the insertion hole is provided at the distal end portion of the ink supply pipe.

7. The ink-jet printer according to claim 1, wherein the at least one ink-jet head comprises a plurality of ink-jet heads, and wherein the ink supplier is configured to supply ink to the ink introduction ports of the ink-jet heads.

8. The ink-jet printer according to claim 7, wherein the ink supplier comprises a plurality of ink supply pipes and a plurality of branchers, a distal end portion of each of the ink supply pipes being connected to a corresponding one of the branchers, and branch pipes of each of the branchers extending to ink introduction ports of corresponding ones of the ink-jet heads.

9. The ink-jet printer according to claim 7, wherein the ink supplier comprises a plurality of ink supply pipes and a plurality of branchers, a distal end portion of each of the ink supply pipes being connected to a corresponding one of the branchers, and branch pipes of each of the branchers extending to ink introduction ports of a corresponding one of the ink-jet heads.

10. The ink-jet printer according to claim 1, wherein the first ink introduction port and the second ink introduction port are located at different positions in a direction intersecting the reciprocating direction of the carriage.

11. The ink-jet printer according to claim 1, wherein the ink supply pipe comprises a rotatable pipe as the distal end of the ink supply pipe, and a tube extending between the rotatable pipe and the ink source, and the rotatable pipe is configured to rotate about the axis perpendicular to the reciprocating direction of the carriage.

12. The ink-jet printer according to claim 1, wherein the first ink introduction port and the second ink introduction port are provided in a top surface of the at least one ink-jet head, and the brancher is above and separated from the top surface.

13. The ink-jet printer according to claim 1, wherein the first branch pipe extends from the brancher toward the first ink introduction port diagonally with respect to the direction perpendicular to the reciprocating direction of the carriage, and the second branch pipe extends from the brancher toward the second ink introduction port diagonally with respect to the direction perpendicular to the reciprocating direction of the carriage.

* * * * *